US011808010B2

(12) United States Patent
P H

(10) Patent No.: US 11,808,010 B2
(45) Date of Patent: Nov. 7, 2023

(54) METHOD AND SYSTEM FOR OPERATING IMPLEMENT ASSEMBLIES OF MACHINES

(71) Applicant: Caterpillar Underground Mining Pty, Ltd., South Burnie (AU)

(72) Inventor: Pradeep Kumar P H, Chennai (IN)

(73) Assignee: Caterpillar Underground Mining Pty. Ltd., Geneva (CH)

( * ) Notice: Subject to any disclaimer, the term of this patent is extended or adjusted under 35 U.S.C. 154(b) by 358 days.

(21) Appl. No.: 17/018,698

(22) Filed: Sep. 11, 2020

(65) Prior Publication Data

US 2021/0095442 A1 Apr. 1, 2021

(30) Foreign Application Priority Data

Oct. 1, 2019 (AU) ..... 2019240588

(51) Int. Cl.
*E02F 9/20* (2006.01)
*E02F 3/84* (2006.01)

(52) U.S. Cl.
CPC ..... *E02F 9/2045* (2013.01); *E02F 9/205* (2013.01); *E02F 3/844* (2013.01)

(58) Field of Classification Search
CPC ..... E02F 9/2045; E02F 9/205; E02F 3/844; E02F 9/262; E02F 3/434; E02F 9/2029; E02F 3/439; E02F 9/2041; E02F 9/265; G01S 19/42; G01S 2013/93271; G01S 2013/93272; B60W 60/001; G05D 1/0278
See application file for complete search history.

(56) References Cited

U.S. PATENT DOCUMENTS

| | | | |
|---|---|---|---|
| 3,642,159 | A | 2/1972 | Askins |
| 7,578,079 | B2 | 8/2009 | Furem |
| 9,587,369 | B2 | 3/2017 | Fletcher et al. |
| 9,714,497 | B2 | 7/2017 | Hague |
| 9,938,688 | B2 | 4/2018 | Fletcher et al. |
| 2006/0245896 | A1 | 11/2006 | Alshaer |

(Continued)

FOREIGN PATENT DOCUMENTS

| | | |
|---|---|---|
| EP | 2990537 B1 | 6/2017 |
| WO | 2015191224 | 12/2015 |

(Continued)

OTHER PUBLICATIONS

Gowda, Mahanth, et al. "Tracking drone orientation with multiple GPS receivers", Oct. 2016, Association for Computing Machinery (ACM), MobiCom '16: Proceedings of the 22nd Annual International Conference on Mobile Computing and Networking, pp. 280-293. (Year: 2016).*

*Primary Examiner* — James M McPherson
*Assistant Examiner* — Kyle J Kingsland

(57) ABSTRACT

A method for operating an implement assembly of a machine at a worksite is disclosed. The implement assembly is adapted to receive a load from a location, haul the load, and dump the load at a dump location. The method includes detecting, by a controller, a movement of the machine towards the location. Further, the method includes moving, by the controller, the implement assembly from a first state to a second state if at least one parameter associated with the machine relative to the location falls below a corresponding parameter threshold during the movement of the machine towards the location.

13 Claims, 6 Drawing Sheets

(56) References Cited

U.S. PATENT DOCUMENTS

| | | | | |
|---|---|---|---|---|
| 2015/0240453 | A1* | 8/2015 | Jaliwala | G01S 19/14 701/50 |
| 2015/0308070 | A1* | 10/2015 | Deines | E02F 3/434 701/50 |
| 2016/0053460 | A1* | 2/2016 | Singh | E02F 3/434 701/50 |
| 2016/0281323 | A1 | 9/2016 | Imaizumi | |
| 2017/0002540 | A1 | 1/2017 | Fletcher et al. | |
| 2017/0121930 | A1 | 5/2017 | Yoshiki et al. | |
| 2017/0247860 | A1 | 8/2017 | Mäkelä et al. | |
| 2018/0002899 | A1 | 1/2018 | Morimoto | |
| 2018/0080193 | A1 | 3/2018 | Myers | |
| 2018/0245316 | A1 | 8/2018 | Forcash et al. | |
| 2020/0042003 | A1* | 2/2020 | Pfaff | E02F 3/3414 |

FOREIGN PATENT DOCUMENTS

| | | |
|---|---|---|
| WO | 2017112534 | 6/2017 |
| WO | 2018217513 | 11/2018 |

* cited by examiner

METHOD AND SYSTEM FOR OPERATING IMPLEMENT ASSEMBLIES OF MACHINES

CROSS-REFERENCE TO RELATED APPLICATION

This application claims priority under 35 USC § 119 and the Paris Convention to Australian Patent Application No. 2019240588 filed on Oct. 1, 2019.

TECHNICAL FIELD

The present disclosure relates to a method and system for operating a machine in an underground worksite. More particularly, the present disclosure relates to a method and system for controlling an implement assembly of the machine.

BACKGROUND

Machines, such as a loaders, working in environments, such as underground worksites, are equipped with implements (e.g., buckets) for the purposes of digging, loading, transporting, and dumping, all manner of materials from a load site to a dump location. According to a typical work cycle involving a loader with a bucket, the loader is generally maneuvered up to a heap of materials, the bucket is lowered, and an edge of the bucket is pushed through the materials so as to scrape, scoop, and receive a quantity of the material within a cavity of the bucket. Thereafter, the bucket is raised to allow the machine to suitably tram through the limited passageways available in the underground worksite up to the dump location where the materials may be released. With the ever increasing desire to optimize and/or improve productivity and deliver much produce in time, various working parameters of such work cycles may be improved.

US Publication no. 20170247860 relates to a method for controlling loading of material to a bucket of a work machine from a stack of material. The method includes selecting a control profile of at least one of a bucket and a boom of the work machine as a function of a distance traveled by the work machine with reference to a reference location.

Reference to any prior art in the specification is not an acknowledgement or suggestion that this prior art forms part of the common general knowledge in any jurisdiction or that this prior art could reasonably be expected to be combined with any other piece of prior art by a skilled person in the art.

By way of clarification and for avoidance of doubt, as used herein and except where the context requires otherwise, the term "comprise" and variations of the term, such as "comprising", "comprises" and "comprised", are not intended to exclude further additions, components, integers or steps.

SUMMARY OF THE INVENTION

In an aspect of the present disclosure, a method for operating an implement assembly of a machine at a worksite is disclosed. The implement assembly is adapted to receive a load from a location, haul the load, and dump the load at a dump location. The method includes detecting, by a controller, a movement of the machine towards the location. The method also includes moving, by the controller, the implement assembly from a first state to a second state if at least one parameter associated with the machine relative to the location falls below a corresponding parameter threshold during the movement of the machine towards the location.

In another aspect of the present disclosure, a system for operating an implement assembly of a machine at a worksite is disclosed. The implement assembly is adapted to receive a load from a location, haul the load, and dump the load at a dump location. The system includes a controller configured to detect a movement of the machine towards the location. The controller is further configured to move the implement assembly from a first state to a second state if at least one parameter associated with the machine relative to the location falls below a corresponding parameter threshold during the movement of the machine towards the location.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
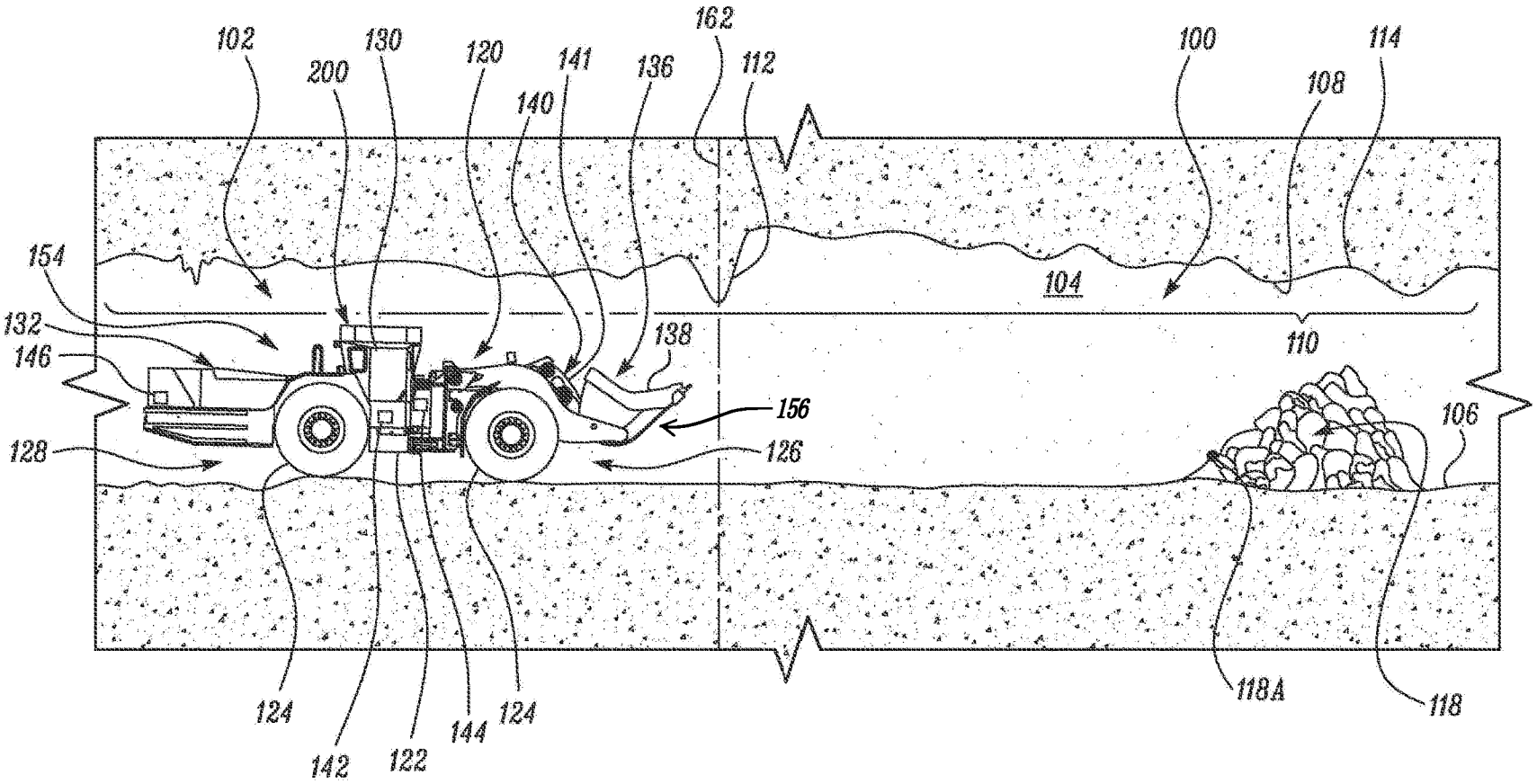
FIG. 1 illustrates a side view of a machine operating at a worksite, in accordance with an embodiment of the present disclosure.
Figure 2:
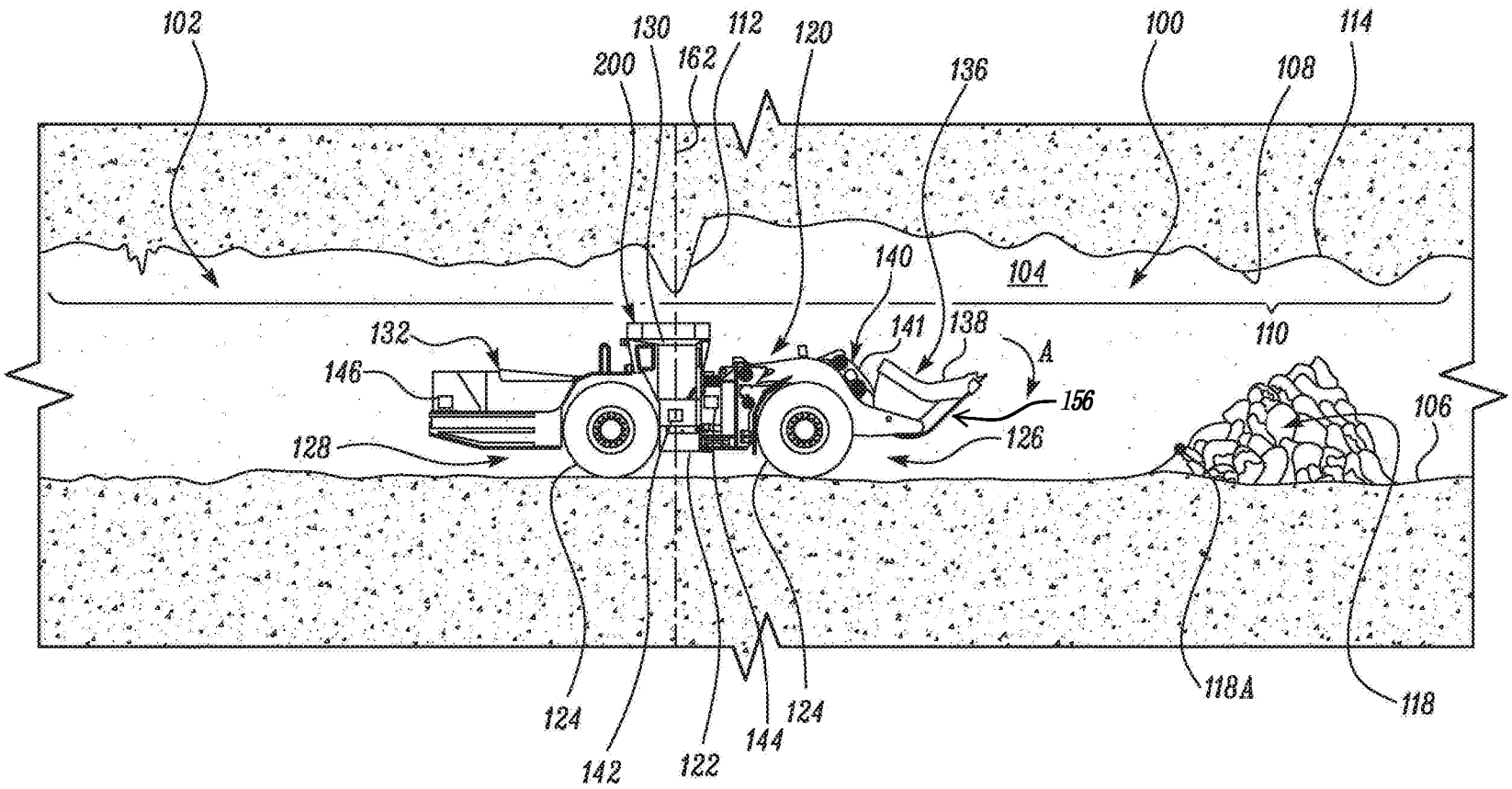
FIG. 2 illustrates a side view of the machine moving towards a location at the worksite to receive a load, in accordance with an embodiment of the present disclosure.
Figure 3:
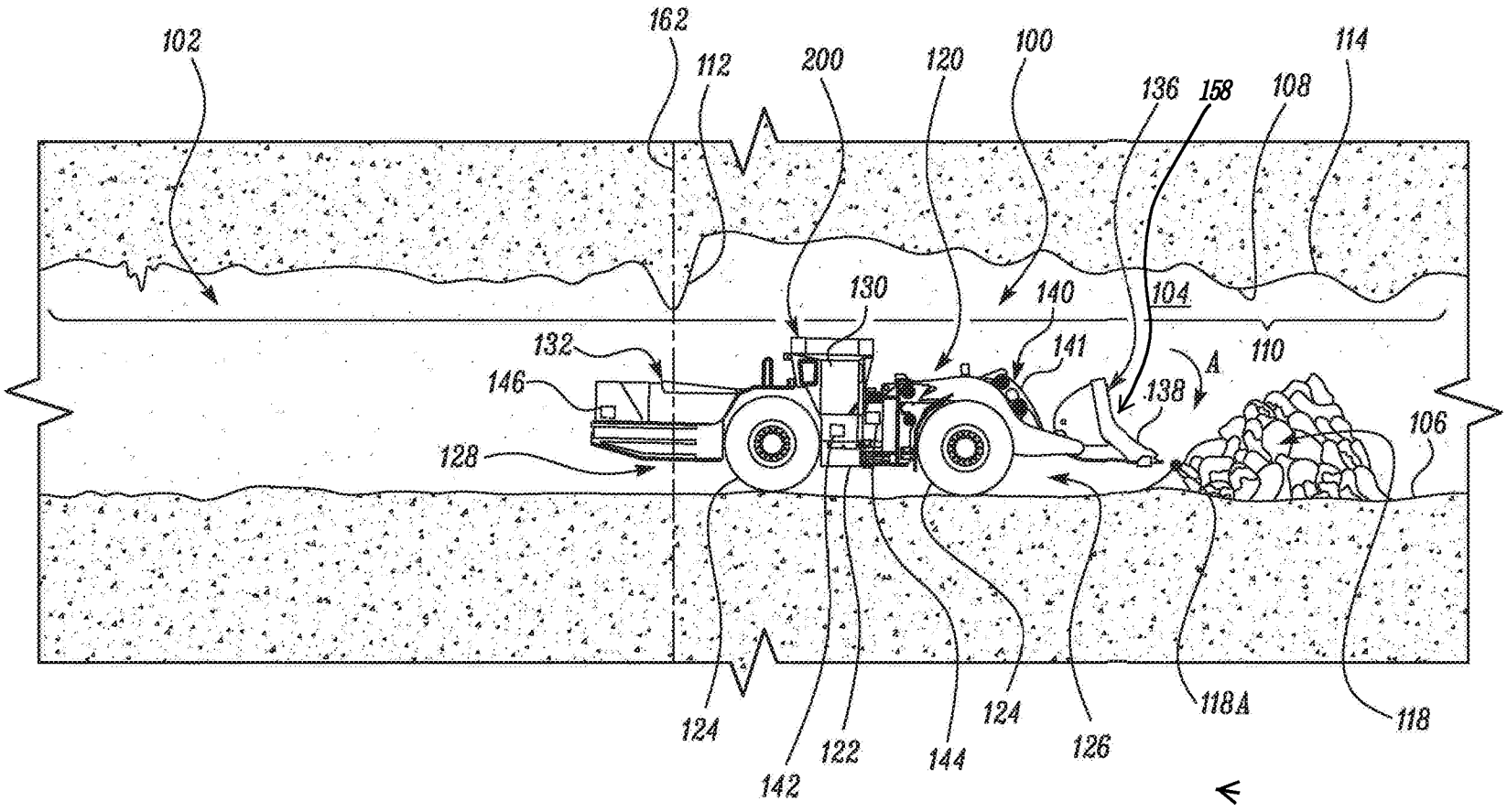
FIG. 3 illustrates a side view of the machine in which the machine is close enough to the location to receive the load from the location, in accordance with an embodiment of the present disclosure.

Referring now to FIG. 1-FIG. 3, a side view of a machine 120 operating within the worksite 100 is illustrated. The worksite 100 may include an underground mine site. However, in various other embodiments, the worksite 100 may embody and/or include, for example, a landfill, a quarry, a construction site, or any other type of worksites. The worksite 100 includes a terrain 102 having one or more sidewalls 104, a ground surface 106, and a ceiling 108. FIGS. 1-3 present a side view of the machine 120 working at the worksite 100 with only one sidewall 104 visible. However, it may be understood that another sidewall exists, in spite of not being disclosed in the figures. Each of the sidewalls 104, the ground surface 106, and the ceiling 108, may include a profile. In an embodiment, the ceiling 108 may have profile 110 including a plurality of crests 112, a plurality of troughs 114, etc., and the ground surface 106 may include at least one heap of materials 118 from where the machine 120 may receive load within the worksite 100.

The machine 120 may be tasked with altering the geography at the worksite 100. The machine 120 may be a mobile machine configured to perform operations associated with industries related to mining, construction, farming, or any other industry known in the art. In the embodiment disclosed, the machine 120 is illustrated as an underground mining load-haul-dump (LHD) loader, which may be used to receive a load from a location 118A where the heap of materials 118 is situated, haul the load away from the location 118A, and dump the load at a dump location (not shown). However, in various other embodiments, the machine 120 may embody different kinds of machines configured to perform operations such as a dozing operation, a grading operation, a leveling operation, or any other type of operation that results in geographical modifications within the worksite 100.

The machine 120 includes a frame 122 and one or more traction assemblies 124 coupled to the frame 122. The frame 122 includes a forward end 126 and a rearward end 128, and is configured to support various components/systems of the machine 120 such as, but not limited to, an operator cab 130, a power producing system 132, an implement assembly 136, and a transmission system (not illustrated). The operator cab 130 may be defined as an enclosure that may include one or more of electronic panels, displays, buttons, joysticks, and various other physically actuable entities. Actuations of such entities, buttons, joysticks, etc. may actuate or move the one or more systems present in the machine 120.

The power producing system 132 may be disposed at or towards the rearward end 128 of the frame 122. The power producing system 132 may include a compartment having a power source (not shown) in the form of an engine or an electric motor that is configured to produce torque/power to operate various systems of the machine 120. In an embodiment, the power source may be a diesel engine. In various other embodiments, the power source may be any engine running on solid, liquid, or gaseous fuel. In the embodiment illustrated, the machine 120 includes one power source. However, it may be contemplated that in various other embodiments, the machine 120 may include more than one power source configured to produce torque/power for operating various systems of the machine 120.

The implement assembly 136 is coupled to the forward end 126 of the frame 122 of the machine 120. The implement assembly 136 may be configured to engage with the terrain 102 (i.e. one or more sidewalls 104, ground surface 106 and ceiling 108) and perform a desired operation. In an embodiment, the implement assembly 136 may be adapted to receive a load from the location 118A, haul the load, and dump the load at a dump location (not shown). The implement assembly 136 may include an implement 138 and a linkage assembly 140. The implement 138 may be a bucket or a work tool known in the art that may be configured to engage with the terrain 102, for example, the heap of materials 118 at the location 118A. The linkage assembly 140 may include a linkage 141 coupled (e.g., movably) to the frame 122 of the machine 120, and the implement 138 may be in turn coupled to the linkage 141. The linkage assembly 140 may include one or more hydraulic actuators (not shown) to facilitate movement of the linkage 141 and/or the implement 138 relative to the frame 122.

Figure 4:
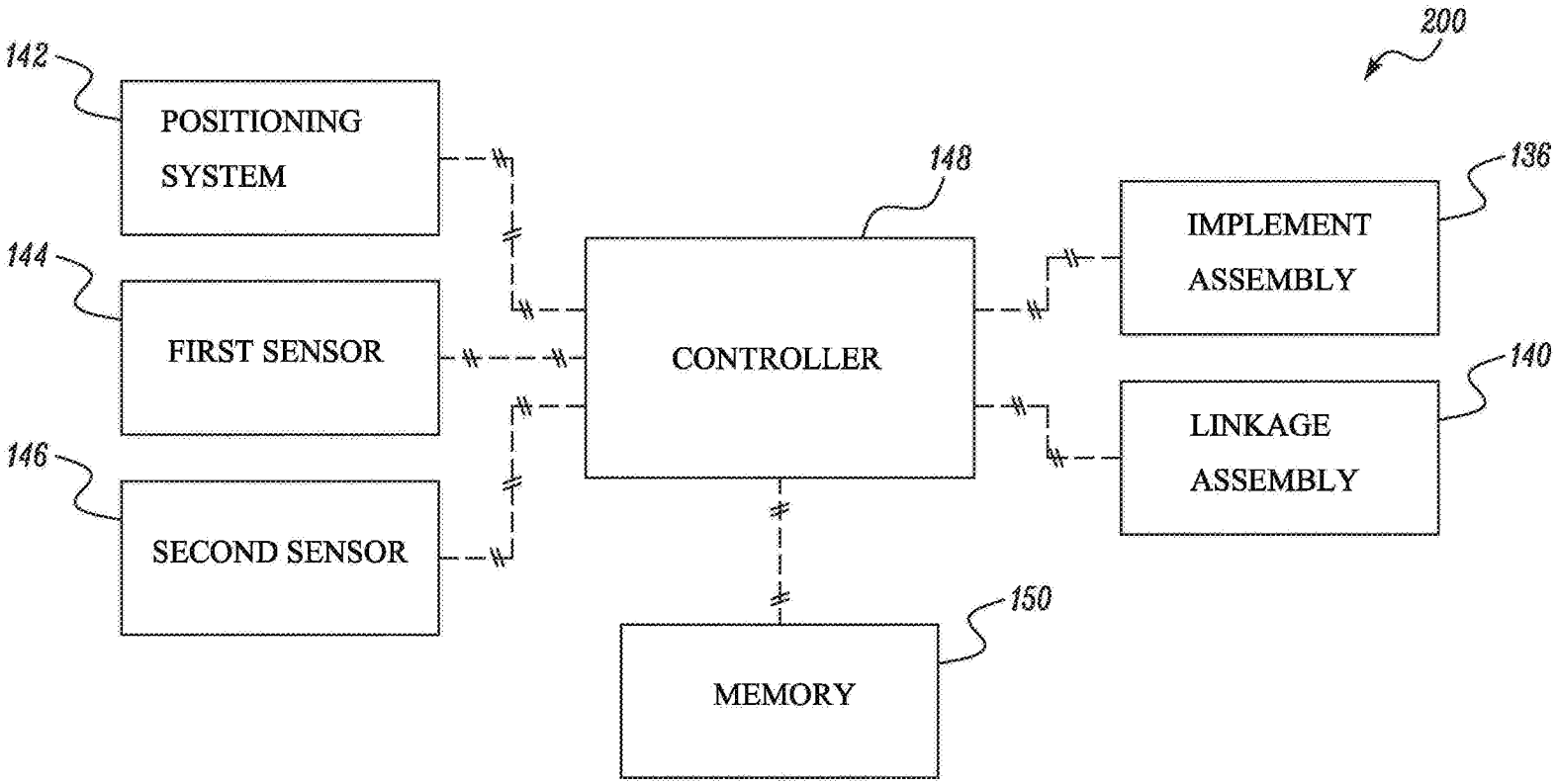
FIG. 4 illustrates a system for operating an implement assembly of the machine at the worksite, in accordance with an embodiment of the present disclosure.

Referring to FIG. 4, the machine 120 includes a system 200 for operating the implement assembly 136 of the machine 120. The system 200 may be configured to control various components/assemblies of the machine 120 and/or the machine 120 based on suitable instructions (as will be described later in the specification).

The system 200 includes a positioning system 142. The positioning system 142 may be configured to generate a positional data of the underground loader/machine 120 within the worksite 100. The positioning system 142 may include a plurality of individual sensors that cooperate to generate and provide position signals indicative of the position of the machine 120 in the worksite 100. For example, the positioning system 142 may include one or more position sensors that interact with at least one of a Global Navigation Satellite System (GNSS), a Global Positioning System (GPS), an Inertial Navigation System, an underground worksite system (equipped with sensors for detecting the position of features and/or machine 120) or any other known position detection system known in the art, to generate the positional data of the machine 120. In another example, the positioning system 142 may include a perception based system, such as a light detection and ranging (LIDAR) device, a radio detection and ranging (RADAR) device, a stereo camera, a monocular camera, or another device known in the art, to generate the positional data of the machine 120.

The system also includes a first sensor 144 and a second sensor 146. The first sensor 144 may be disposed at the forward end 126 of the frame 122 of the machine 120. The first sensor 144 is configured to generate data related to a first position of the forward end 126 of the machine 120 relative to the location 118A. The second sensor 146 may be disposed at the rearward end 128 of the frame 122 of the machine 120. The second sensor 146 is configured to generate data related to a second position of the rearward end 128 of the machine 120 relative to the location 118A. For example, the first sensor 144 and the second sensor 146 may be configured to interact with any one of a Global Navigation Satellite System (GNSS), a Global Positioning System (GPS), an Inertial Navigation System, an underground worksite system (equipped with sensors for detecting the position of features and/or machine 120) or any other known position detection system known in the art, to generate the positional data associated with the forward end 126 and the rearward end 128 of the machine 120 relative to the location 118A. In another embodiment, the first sensor 144 and the second sensor 146 may be perception sensors, such as a light detection and ranging (LIDAR) device, a radio detection and ranging (RADAR) device, a stereo camera, a monocular camera, or another device known in the art, to gather and generate the positional data associated with the forward end 126 and the rearward end 128 of the machine 120.

The system 200 further includes a controller 148. The controller 148 is communicably coupled to the implement assembly 136, the linkage assembly 140, the positioning system 142, the first sensor 144, and the second sensor 146. For example, the controller 148 is coupled to the actuators of the implement assembly 136 enabling actuation of the implement 138 relative to the linkage 141 and/or enabling actuation of the linkage 141 relative to the frame 122. Based on data/information received from at least one of the positioning system 142, the first sensor 144, and the second sensor 146, the controller 148 may control the actuation of at least one of the one or more actuators of the implement assembly 136, which in turn may control the position and movement of the implement 138 relative to the linkage 141.

In some embodiments, the controller 148 may also be configured to operate the machine 120 within the worksite 100. For example, the controller 148 may be communicably coupled to the power producing system 132 so as to operate the power producing system 132 and facilitate a movement of the machine 120 in the worksite 100. In so doing, the controller 148 may also seek data related to various parameters related to a working of the power producing system 132, e.g., a speed of the power producing system 132.

Figure 6:
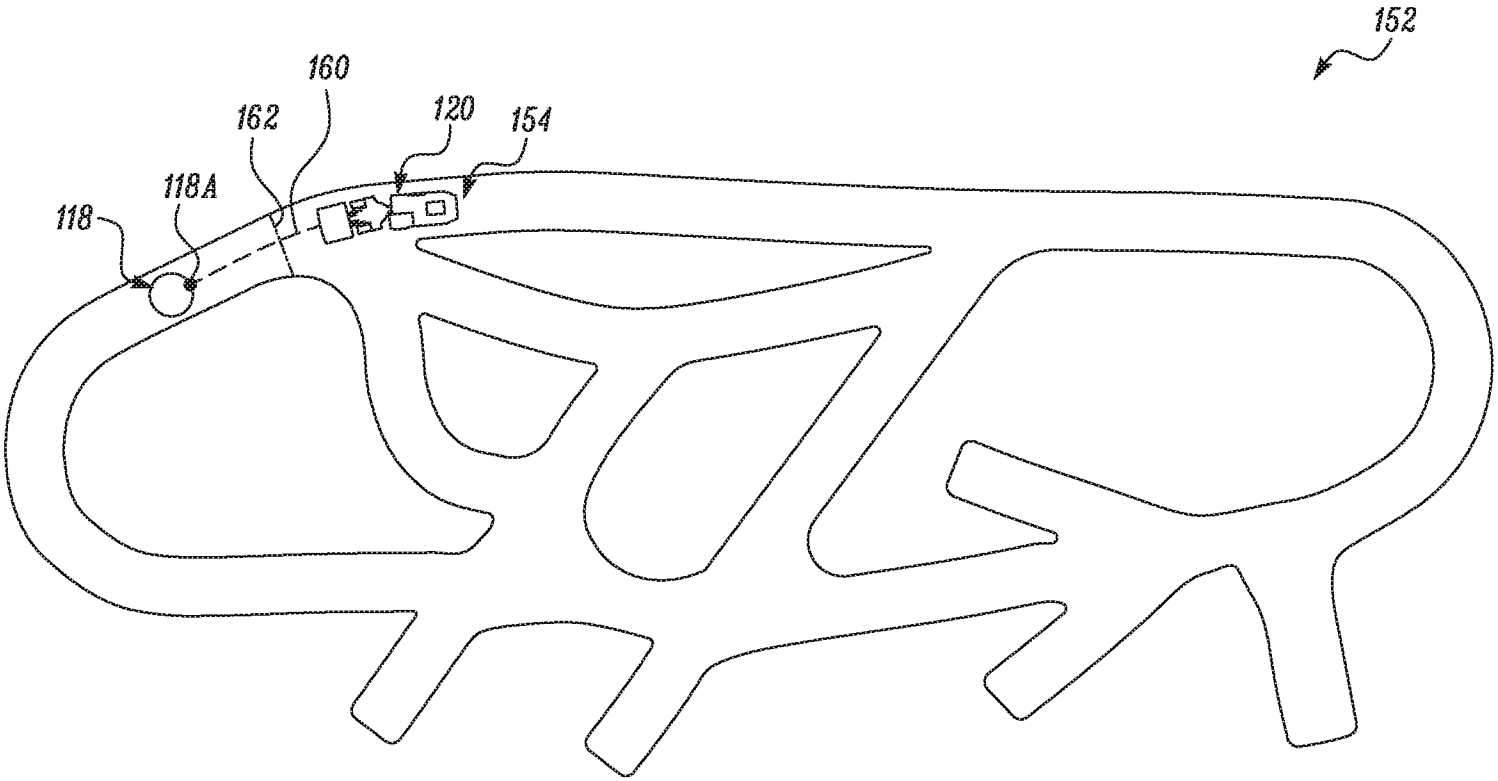
FIG. 6 illustrates a map of the worksite, in accordance with an embodiment of the present disclosure.

It should be appreciated that the controller 148 may include a microprocessor capable of controlling numerous machine functions. The controller 148 may include a memory 150, a secondary storage device, a processor, and any other components for running an application. The memory 150 may include one or more maps 152 (shown in FIG. 6) of the worksite 100. The one or more maps 152 facilitates the controller 148 to retrieve the position of the machine 120 as well as the location 118A associated with the heap of materials 118 within the worksite 100. Various other circuits may be associated with the controller 148 such as power supply circuitry, signal conditioning circuitry, solenoid driver circuitry, and other types of circuitry.

In an aspect of the present disclosure, the controller 148, using the data/information from at least one of the positioning system 142, the first sensor 144, and the second sensor 146, may be configured to detect a movement of the machine 120 towards the location 118A. In an embodiment, the controller 148 may detect the movement of the machine 120 by determining a position of the machine 120, determining the location 118A within the worksite 100 for receiving the load into the machine 120, and calculating a decreasing distance between the position of the machine 120 and the location 118A. The controller 148 may be further configured to move the implement assembly 136 from a first state to a second state if at least one parameter associated with the machine 120 relative to the location 118A falls below a corresponding parameter threshold during the movement of the machine 120 towards the location 118A. A detailed understanding of the first state and the second state of the implement assembly 136, parameters associated with the machine 120 relative to the location 118A, and the controller's 148 capabilities will be described in detail further below.

INDUSTRIAL APPLICABILITY

Figure 5:
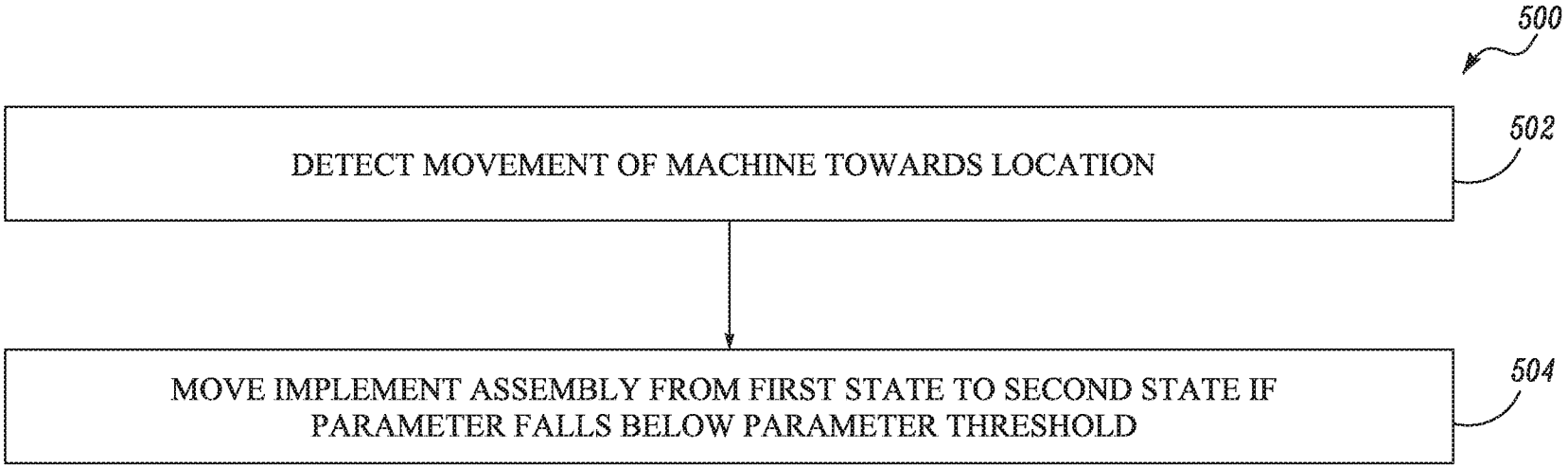
FIG. 5 depicts a method for operating the implement assembly of the machine at the worksite, in accordance with an embodiment of the present disclosure.

With reference to FIG. 5, an exemplary method 500 for operating the implement assembly 136 of the machine 120, by the controller 148, will now be discussed. The method 500 is discussed by way of a flowchart, that illustrates exemplary stages/steps (i.e., from 502 to 504) associated with the method 500, and is discussed in conjunction with FIGS. 1-4, and FIG. 6, of the present disclosure.

Furthermore, for the purpose of the ongoing disclosure, it may be assumed that the machine 120 (i.e. the underground loader) is at an initial position, such as a position '154' (see FIG. 1) within the worksite 100. At said position 154, the controller 148 may generate a signal to perform the method 500. More particularly, the controller 148 may receive the signal for starting autonomous movement of the implement assembly 136 from a first state 156 (shown in FIGS. 1 and 2) to a second state 158 in a direction 'A' (shown in FIGS. 2 and 3), as the machine 120 trams from the position 154 towards the location 118A.

The first state 156 and the second state 158 of the implement assembly 136 may be based on a lift and/or a tilt of the implement 138 relative to the linkage 141 and/or tilt and/or a lift of the linkage 141 relative to the frame 122 of the machine 120. In this regard, the controller 148 may actuate the actuators of the implement assembly 136, to move the implement assembly 136 between the first state 156 and the second state 158. According to the depicted embodiment, the controller 148 defines the first state 156 as a state in which the both the linkage 141 and the implement 138 are in a retractable state, and defines the second state 158 in which the implement 138 is pivoted and extended away from the linkage 141 further forward (i.e., in a direction defined from the rearward end 128 towards the forward end 126 of the frame 122 (see direction, A, FIGS. 1, 2, and 3).

In an embodiment, in the first state 156, the implement assembly 136 facilitates a tramming of the machine 120 in the worksite 100, and in the second state 158, the implement assembly 136 facilitates performance of a scooping operation to receive the load from the location 118A of the heap of materials 118. Additionally, the controller 148 defines the second state 158 of the implement assembly 136 such that the implement 138 is maintained at a minimum height from the ground surface 106 so as to prevent the implement 138 from colliding against the ground surface 106.

Upon receipt of the signal for starting the autonomous movement of the implement assembly 136, the controller 148 detects the movement of the machine 120 towards the location 118A within the worksite 100 (STEP 502). In an embodiment, the controller 148 may detect the movement of the machine 120 by determining the position 154 of the machine 120 within the worksite 100, determining the location 118A within the worksite 100 for receiving the load into the machine 120, and subsequently, calculating a decreasing distance between the position 154 of the machine 120 and the location 118A.

The controller 148 may make use of the positioning system 142 and the one more pre-stored maps 152 of the worksite 100 (within the memory 150 of the controller 148) to determine the position 154 of the machine 120 in the worksite 100. In an embodiment, the controller 148 may command the positioning system 142 to gather at least one of two-dimensional or three-dimensional position coordinates of the machine 120. On receiving the position coordinates of the machine 120 from the positioning system 142, the controller 148 may mark the corresponding detected position of the machine 120 on the map 152. This position marked on the map 152 may correspond to the (initial) position 154 of the machine 120.

In another embodiment, the controller may make use of the first sensor 144 and the second sensor 146 to determine the position 154 of the machine 120. To determine the position of the machine 120 by way of the first sensor 144 and the second sensor 146, the worksite 100 may be provided with a plurality of position detecting sensors (e.g., proximity sensors) disposed at specific positions within the worksite 100. Such sensors may be able to communicate with the first sensor 144 and/or the second sensor 146 to determine the position of the forward end 126 and the rearward end 128 of the machine 120. Positions of the plurality of position detecting sensors dispersed within the worksite 100 may be pre-stored on the map 152. The controller 148 may communicate with said position detecting sensors dispersed within the worksite 100 to detect the distance of the forward end 126 and/or the rearward end 128 of the machine 120 from the said position detecting sensors. By collating and processing the detected distance between each sensor (i.e., the first sensor 144, the second sensor 146) and the position of the position detecting sensors, and because the controller 148 knows the position of the position detecting sensors on the map 152, the controller 148 may compute and establish the position 154 of the machine 120 on the map 152.

In yet another embodiment, the machine 120 is an articulated underground loader having at least one of the positioning system 142, the first sensor 144, and the second sensor 146 located at a pivot point (not shown) of the machine 120. In this exemplary scenario, the controller 148 may gather at least one of two-dimensional or three-dimensional position coordinates of the pivot point of the machine 120 using at least one of the positioning system 142, the first sensor 144, and the second sensor 146, mark the gathered position coordinates of the pivot point of the machine 120 on the map 152, and accordingly, calculate the distance between the pivot point of the machine 120 and the location 118A. Various other techniques may be employed to detect the position 154 of the machine 120, without departure from the claimed subject matter.

Pursuant to the determination of the position 154 of the machine 120, the controller 148 also determines the location 118A of the heap of materials 118. In an embodiment, the location 118A of the heap of materials 118 may be prestored in the map 152, and the controller 148 may retrieve the location 118A related to the heap of materials 118 from the pre-stored map 152. In case the machine 120 includes an autonomous machine, the machine 120 may run on a predefined route (see route 160, FIG. 6) for the machine 120 to tram (i.e., move) from the position 154 to the location 118A of the heap of materials 118. Position 154 may be predefined on such a route, and as soon as the machine 120 reaches up to the position 154 marked on the route, the controller 148 may generate a signal to perform the method 500.

Further, the controller 148 may detect the orientation of the machine 120 during the movement of the machine 120 towards the location 118A. The controller 148 may detect the orientation to determine that the machine 120 is approaching towards the location 118A with the implement assembly 136 facing towards the location 118A. The controller 148 may detect the orientation of the machine 120 before initiating the movement of the implement assembly 136 from the first state 156 to the second state 158. For example, the controller 148 may initiate the movement of the implement assembly 136 if the controller 148 detects that the machine 120 is moving towards the location 118A with the implement assembly 136 facing towards the location 118A. In another example, the controller 148 does not initiate the movement of the implement assembly 136 if the controller 148 detects that the machine 120 is moving towards the location 118A with the implement assembly 136 facing away from the location 118A.

In an embodiment, the controller 148 may determine the orientation of the machine 120 based on forward/reverse movement of the machine 120 towards the location 118A. For example, on determining that the machine 120 is moving forward (e.g., in a forward gear) towards the location 118A, the controller 148 may detect that the machine 120 is moving towards the location 118A with the implement assembly 136 facing towards the location 118A. In another example, if the machine 120 is moving reverse (e.g., in a reverse gear) towards the location 118A, the controller 148 detects that the machine 120 is moving towards the location 118A with the implement assembly 136 facing away from the location 118A.

In another embodiment, the controller 148 receives data related to the first position and the second position from the first sensor 144 and the second sensor 146 respectively, computes a first distance between the first position and the location 118A, computes a second distance between the second position and the location 118A, and accordingly, determine the approach of the machine 120 towards the location 118A with the implement assembly 136 facing towards the location 118A (if the first distance is less than the second distance), or facing away from the location 118A (if the second distance is less than the first distance).

More specifically, the controller 148 may command the first sensor 144 and the second sensor 146 to gather position coordinates related to the first position of the forward end 126 and the second position of the rearward end 128 of the machine 120. On receiving the position coordinates related to the forward end 126 (from the first sensor 144) and the rearward end 128 (from the second sensor 146), the controller 148 may compare the received position coordinates with the location 118A on the worksite 100 on the map 152 to retrieve the first position and the second position. In further detail, the controller 148 computes the first distance between the first position and the location 118A, and the second distance between the second position and the location 118A. Next, the controller 148 compares the first distance and the second distance. If the first distance is less than the second distance, the controller 148 may determine that the machine 120 is approaching towards the location 118A with the implement assembly 136 facing towards the location 118A. However, if the second distance is less than the second distance, the controller 148 may determine that the machine 120 is approaching towards the location 118A with the implement assembly 136 facing away from the location 118A. For the purpose of better understanding, exemplary situations and numerical values will be taken. Let it be assumed that:

- the first distance between the first position related to the forward end 126 and the location 118A is 10 meters;
- the second distance between the second position related to the rearward end 128 and the location 118A is 18 meters.

In the exemplary scenario, the controller 148 determines that the first distance is less than the second distance. Accordingly, the controller 148 determines that the machine 120 is approaching towards the location 118A with the implement assembly 136 facing towards the location 118A.

In another exemplary scenario, let it be assumed that:

- the first distance between the first position related to the forward end 126 and the location 118A is 18 meters;
- the second distance between the second position related to the rearward end 128 and the location 118A is 10 meters.

In this exemplary scenario, the controller 148 determines that the second distance is less than the first distance. Accordingly, the controller 148 determines that the machine 120 is approaching towards the location 118A with the implement assembly 136 facing away from the location 118A.

Subsequent to STEP 502, the method 500 initiates STEP 504. In said step, the controller 148 controls the movement of the implement assembly 136. More specifically, the controller 148 controls the movement of the implement assembly 136 from the first state 156 to the second state 158 based on at least one parameter, associated with the machine 120, as the machine 120 approaches the location 118A. The controller 148 initiates the movement of the implement assembly 136 from the first state 156 to the second state 158 if the at least one parameter associated with the machine 120 related to the location 118A falls below a corresponding parameter threshold during the movement of the machine 120 towards the location 118A.

In an embodiment, the at least one parameter associated with the machine 120 relative to the location 118A corresponds to a distance between the machine 120 and the location 118A. A detailed understanding of STEP 504 considering the distance as the parameter will now be explained using an exemplary scenario. In an embodiment, STEP 504 starts as soon as the controller 148 detects the movement of the machine 120 towards the location 118A. In said step, the controller 148 selects a distance threshold value between the machine 120 and the location 118A as a parameter threshold to initiate the movement of the implement assembly 136 as the machine 120 approaches toward the location 118A. The controller 148 determines the position of the machine 120 in real time, and accordingly, calculates a distance value between the position of the machine 120 and the location 118A. Also, the controller 148 compares the real time distance value with a distance threshold value relative to the location 118A. The distance threshold value is shown as a centerline labeled '162' in FIGS. 1, 2, 3, and 6. In an embodiment, the distance threshold value may be a fixed threshold value and may be pre-stored in the memory 150 of the controller 148. For example, the pre-stored distance threshold value relative to the location 118A is 5 meters.

In some embodiments, the controller 148 may determine the distance threshold value dynamically. For example, considering the possibility of the machine 120 to move along one or more routes to travel up to the location 118A, the controller 148 may set the distance threshold value to a corresponding distance when the machine 120 trams along one route towards the location 118A, and/or may set the distance threshold value to another corresponding distance when the machine 120 trams along another route towards location 118A.

In yet another embodiment, the controller 148 may determine the distance threshold value dynamically based on an approaching speed of the machine 120 moving towards the location 118A. For example, larger the speed of machine travel, larger may be the distance threshold value set relative to the location 118A. For example, the controller 148 may set the distance threshold value to 5 meters if the approaching speed of the machine 120 moving towards the location 118A is 10 kilometer per hour. In another example, the controller 148 may set the distance threshold value to 3 meters if the approaching speed of the machine 120 moving towards the location 118A is 7 kilometer per hour.

In yet another embodiment, the controller 148 may determine the distance threshold value based on a response time and/or actuation speed of the one or more actuators associated with the implement assembly 136 of the machine 120. For example, the controller 148 may set the distance threshold value to a corresponding distance value such that there is sufficient response time for the actuators associated with the implement assembly 136 to move the implement assembly 136 from the first state 156 to the second state 158 as the machine 120 moves from the distance threshold value up to the location 118A at a preset machine speed.

In another embodiment, the parameter associated with the machine 120 relative to the location 118A may correspond to a speed of movement of the machine 120 towards the location 118A. A detailed understanding of STEP 504 considering the speed of movement of the machine 120 as the parameter will now be explained using an exemplary scenario. In an embodiment, STEP 504 starts as soon as the controller 148 detects the movement of the machine 120 along the route 160 towards the location 118A. In said STEP 504, the controller 148 selects a speed threshold value of movement of the machine 120 towards the location 118A as a parameter to initiate the movement of the implement assembly 136 as the machine 120 approaches toward the location 118A. The controller 148 determines an actual speed of movement of the machine 120 in real time as the machine 120 approaches toward the location 118A. The controller 148 may receive the actual speed values from one or more speed sensors (not shown) associated with the machine 120. Subsequent to the movement of the machine 120 towards the location 118A, the controller 148 compares the actual speed with the speed threshold value of movement of the machine 120.

In an exemplary embodiment, the speed threshold value may be pre-stored in the memory 150 of the controller 148. For example, the pre-stored speed threshold value is 5 kilometers per hour. In another example, the pre-stored speed threshold value is 7 kilometers per hour. In another exemplary embodiment, the controller 148 may consider the profile of the terrain 102 along the route 160 to determine the speed threshold value. In yet another exemplary embodiment, the controller 148 may determine the speed threshold value based on a response time and/or actuation speed of the one or more actuators associated with the implement assembly 136 of the machine 120. For example, the controller 148 may set the speed threshold value to a corresponding speed value such that there is sufficient response time for the actuators associated with the implement assembly 136 to move the implement assembly 136 from the first state 156 to the second state 158 before the machine 120 reaches the location 118A.

The controller 148 initiates the movement of the implement assembly 136 if the at least one parameter falls below the corresponding parameter threshold during the movement of the machine 120 towards the location 118A. For example, the controller 148 initiates the movement of the implement assembly 136 during the tramming of the machine 120 towards the location 118A, if the controller determines that the distance between the position of the machine 120 and the location 118A becomes equal to or less than the distance threshold value (pre-defined by the controller 148). For the purpose of better understanding, exemplary situations and numerical values will be taken. Let it be assumed that:

- pre-defined distance threshold value is 5 meters;
- at time T1, the distance between the current position of the machine 120 and the location 118A is 8 meters;
- at time T2, the distance between the current position of the machine 120 and the location 118A is 5 meters.

In the exemplary scenario, the controller 148 determines that, at time T1, the distance between the current position of the machine 120 and the location 118A is greater than the distance threshold value pre-defined by the controller 148. Accordingly, the controller 148 does not initiate the movement of the implement assembly 136 from the first state 156 to the second state 158 during the movement of the machine 120 towards the location 118A. However, as the machine 120 approaches toward the location 118A, at time T2, the controller 148 determines that the distance between the current position of the machine 120 and the location 118A is equal to the distance threshold value pre-defined by the controller 148. Accordingly, the controller 148 initiates the movement of the implement assembly 136 from the first state 156 to the second state 158 during the movement of the machine 120 towards the location 118A.

In another example, the controller 148 initiates the movement of the implement assembly 136 during the tramming of the machine 120 towards the location 118A, if the controller determines that the speed of movement of the machine 120 towards the location 118A becomes equal to or less than the speed threshold value (pre-defined by the controller 148). For the purpose of better understanding, exemplary situations and numerical values will be taken. Let it be assumed that:

- pre-defined speed threshold value is 5 kilometers per hour;
- at time T1, the speed of movement of the machine 120 towards the location 118A is 8 kilometers per hour;

at time T2, the speed of movement of the machine 120 towards the location 118A is 5 kilometers per hour.

In the exemplary scenario, the controller 148 determines that, at time T1, the speed of movement of the machine 120 towards the location 118A is greater than the speed threshold value pre-defined by the controller 148. Accordingly, the controller 148 does not initiate the movement of the implement assembly 136 from the first state 156 to the second state 158 during the movement of the machine 120 towards the location 118A. However, as the machine 120 approaches toward the location 118A, at time T2, the controller 148 determines that the speed of movement of the machine 120 towards the location 118A is equal to the speed threshold value pre-defined by the controller 148. Accordingly, the controller 148 initiates the movement of the implement assembly 136 from the first state 156 to the second state 158 during the movement of the machine 120 towards the location 118A.

In yet another embodiment, the controller 148 may consider both the distance (between the machine 120 and the location 118A) and the speed of movement of the machine 120 (towards the location 118A) as the parameters to initiate the movement of the implement assembly 136 from the first state 156 to the second state 158. For the purpose of better understanding, exemplary situations and numerical values will be taken. Let it be assumed that:

pre-defined distance threshold value is 5 meters;

pre-defined speed threshold value is 5 kilometers per hour;

at time T1, distance between the current position of the machine 120 and the location 118A is 8 meters, and the speed of movement of the machine 120 towards the location 118A is 4 kilometers per hour.

at time T2, distance between the current position of the machine 120 and the location 118A is 5 meters, and the speed of movement of the machine 120 towards the location 118A is 4 kilometers per hour.

In the exemplary scenario, at time T1, the controller 148 determines that the speed of movement of the machine 120 towards the location 118A is less than the speed threshold value, and the distance between the current position of the machine 120 and the location 118A is greater than the pre-defined distance threshold value. Accordingly, at time T1, the controller 148 does not initiate the movement of the implement assembly 136 from the first state 156 to the second state 158 during the movement of the machine 120 towards the location 118A. However, at time T2, the controller 148 determines that the speed of movement of the machine 120 towards the location 118A is less than the speed threshold value, and the distance between the current position of the machine 120 and the location 118A is equal to the pre-defined distance threshold value. Accordingly, at time T2, the controller 148 initiates the movement of the implement assembly 136 from the first state 156 to the second state 158 during the movement of the machine 120 towards the location 118A.

In another exemplary scenario, let it be assumed that:

pre-defined distance threshold value is 5 meters;

pre-defined speed threshold value is 5 kilometers per hour;

at time T1, distance between the current position of the machine 120 and the location 118A is 4 meters, and the speed of movement of the machine 120 towards the location 118A is 8 kilometers per hour.

at time T2, distance between the current position of the machine 120 and the location 118A is 2 meters, and the speed of movement of the machine 120 towards the location 118A is 5 kilometers per hour.

In this exemplary scenario, at time T1, the controller 148 determines that the distance between the current position of the machine 120 and the location 118A is less than the pre-defined distance threshold value, and the speed of movement of the machine 120 towards the location 118A is greater than the speed threshold value. Accordingly, at time T1, the controller 148 does not initiate the movement of the implement assembly 136 from the first state 156 to the second state 158 during the movement of the machine 120 towards the location 118A. However, at time T2, the controller 148 determines that the distance between the current position of the machine 120 and the location 118A is less than the pre-defined distance threshold value, and the speed of movement of the machine 120 towards the location 118A is equal to the speed threshold value. Accordingly, at time T2, the controller 148 initiates the movement of the implement assembly 136 from the first state 156 to the second state 158 during the movement of the machine 120 towards the location 118A.

Such method 500 and system 200 facilitates automatic positioning of the implement assembly 136 of the machine 120, as the machine moves toward the location 118A of the heap of materials 118, thus preventing the operator from performing the same operation over and over again. Such a system and method helps the operator maintaining a high level of work performance and operational efficiency, reducing operator stress levels.

It will be apparent to those skilled in the art that various modifications and variations can be made to the system of the present disclosure without departing from the scope of the disclosure. Other embodiments will be apparent to those skilled in the art from consideration of the specification and practice of the system disclosed herein. It is intended that the specification and examples be considered as exemplary only, with a true scope of the disclosure being indicated by the following claims and their equivalent.

What is claimed is:

1. A method for operating an implement assembly of a machine at a worksite, the implement assembly adapted to receive a load from a heap of materials, haul the load, and dump the load at a dump location, the method comprising:

detecting, by a controller, a movement of the machine towards the heap of materials;

moving, by the controller, the implement assembly from a first state to a second state while the machine is moving toward but not yet in contact with the heap of materials when at least one parameter associated with the machine relative to the heap of materials falls below a corresponding parameter threshold during the movement of the machine towards the heap of materials;

detecting, by the controller, an orientation of the machine during the movement of the machine towards the heap of materials, wherein the orientation of the machine is detected to determine that the machine is approaching towards the heap of materials with the implement assembly facing towards the heap of materials;

wherein the machine further includes a forward end and a rearward end, the implement assembly being couple to the forward end, and the method further includes:

detecting the orientation of the machine during the movement of the machine towards the heap of materials;

receiving, from a first sensor, data related to a first position of the forward end relative to the heap of materials;

receiving, from a second sensor, data related to a second position of the rearward end relative to the heap of materials;

computing, by the controller, a first distance between the first position and the heap of materials;

computing, by the controller, a second distance between the second position and the heap of materials;

determining, by the controller, the approach of the machine towards the heap of materials with the implement assembly facing towards the heap of materials when the first distance is less than the second distance; and determining, by the controller, approach of the machine towards the heap of materials with the implement assembly facing away from the heap of materials when the second distance is less than the first distance.

2. The method of claim 1, wherein the at least one parameter associated with the machine relative to the heap of materials corresponds to a distance between the machine and the heap of materials.

3. The method of claim 1, wherein the at least one parameter associated with the machine relative to the heap of materials corresponds to a speed of movement of the machine towards the heap of materials.

4. The method of claim 1, wherein, in the first state of the implement assembly the machine is adapted to tram in the worksite.

5. The method of claim 1, wherein, in the second state of the implement assembly the machine is adapted to perform a scooping operation to receive the load from the heap of materials.

6. The method of claim 1, wherein detecting the movement of the machine towards the heap of materials includes:

determining, by the controller, a position of the machine within the worksite;

determining, by the controller, the heap of materials within the worksite for receiving the load into the machine; and calculating, by the controller, a decreasing distance between the position of the machine and the heap of materials.

7. The method of claim 6 further comprising retrieving, by the controller, the position and the heap of materials from a map.

8. The method claim 1, wherein:

the implement assembly includes a linkage coupled to a frame of the machine and an implement coupled to the linkage, and moving the implement assembly from the first state to the second state includes moving at least one of the implement relative to the linkage or the linkage relative to the frame.

9. A system for operating an implement assembly of a machine at a worksite, the implement assembly adapted to receive a load from a location, haul the load, and dump the load at a dump location, the system comprising:

a first sensor to generate data related to a first position of a forward end of the machine relative to the location;

a second sensor to generate data related to a second position of a rearward end of the machine relative to the location, and a controller configured to:

detect a movement of the machine towards the location;

move the implement assembly from a first state to a second state if at least one parameter associated with the machine relative to the location falls below a corresponding parameter threshold during the movement of the machine towards the location; and detect an orientation of the machine during the movement of the machine towards the location, wherein the orientation of the machine is detected to determine that the machine is approaching towards the location with the implement assembly facing towards the location;

wherein the controller is configured to detect the orientation by:

receiving data related to the first position and the second position;

computing a first distance between the first position and the location;

computing a second distance between the second position and the location;

determining the approach of the machine towards the location with the implement assembly facing towards the location when the first distance is less than the second distance; and determining the approach of the machine towards the location with the implement assembly facing away from the location when the second distance is less than the first distance.

10. The system of claim 9, wherein the at least one parameter associated with the machine relative to the location corresponds to a distance between the machine and the location.

11. The system of claim 9, wherein the at least one parameter associated with the machine relative to the location corresponds to a speed of movement of the machine towards the location.

12. The system of claim 9, wherein, in the first state of the implement assembly the machine is adapted to tram in the worksite.

13. The system of claim 9, wherein, in the second state of the implement assembly the machine is adapted to perform a scooping operation to receive the load from the location.

* * * * *